US006363861B1

(12) United States Patent
Strehler

(10) Patent No.: US 6,363,861 B1
(45) Date of Patent: Apr. 2, 2002

(54) BOGIE FOR RAIL VEHICLES

(75) Inventor: Richard Strehler, Langenargen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/673,450

(22) PCT Filed: Apr. 26, 1999

(86) PCT No.: PCT/EP99/02797

§ 371 Date: Oct. 16, 2000

§ 102(e) Date: Oct. 16, 2000

(87) PCT Pub. No.: WO99/56996

PCT Pub. Date: Nov. 11, 1999

(30) Foreign Application Priority Data

Apr. 30, 1998 (DE) ..... 198 19 467

(51) Int. Cl.[7] ..... B61F 3/00

(52) U.S. Cl. ..... 105/182.1; 105/133; 105/136; 105/218.2

(58) Field of Search ..... 105/133, 135, 105/136, 165, 167, 168, 182.1, 199.1, 218.2

(56) References Cited

U.S. PATENT DOCUMENTS

| | | | | | |
|---|---|---|---|---|---|
| 3,945,325 | A | * | 3/1976 | Zehnder | 105/167 |
| 4,356,775 | A | * | 11/1982 | Paton et al. | 105/218.2 |
| 4,461,217 | A | * | 7/1984 | Girod et al. | 105/135 |
| 4,941,409 | A | * | 7/1990 | Richter et al. | 105/218.2 |
| 5,181,473 | A | * | 1/1993 | Petit et al. | 105/133 |
| 5,189,962 | A | * | 3/1993 | Iwamura et al. | 105/218.2 |
| 5,213,049 | A | * | 5/1993 | Kobayashi | 105/168 |
| 5,222,442 | A | * | 6/1993 | Tack, Jr. | 105/218.2 |
| 5,415,107 | A | | 5/1995 | Tutzauer | 105/218.2 |
| 5,429,056 | A | * | 7/1995 | Pees et al. | 105/168 |
| 5,909,711 | A | * | 6/1999 | Vogel et al. | 105/168 |

FOREIGN PATENT DOCUMENTS

| | | |
|---|---|---|
| AT | 398 557 B | 12/1994 |
| DE | 41 36 926 A1 | 5/1993 |
| DE | 43 22 517 A1 | 2/1994 |
| DE | 44 46 043 C1 | 3/1996 |
| EP | 0 010 619 A1 | 5/1980 |
| EP | 0 384 512 A2 | 8/1990 |
| EP | 0 571 961 A1 | 12/1993 |

* cited by examiner

*Primary Examiner*—S. Joseph Morano
*Assistant Examiner*—Lars A. Olson
(74) *Attorney, Agent, or Firm*—Davis & Bujold, P.L.L.C.

(57) ABSTRACT

The invention is based on a bogie (1) for rail vehicles on which two interconnected wheel bearing housings, in which wheel axles (5) for rail wheels (2) are mounted, are articulated via an oscillating link (10). The rail wheels (2) are driven by means of laterally situated gears (11) which are accommodated in gear housings. In order to simplify the articulation of the rail wheels (2) on the bogie (1) and to reduce the multiplicity of parts, it is proposed that the gear housings (4) form one unit with their associated wheel bearing housings (4) for the wheel axles and the oscillating link (10).

10 Claims, 2 Drawing Sheets

BOGIE FOR RAIL VEHICLES

FIELD OF THE INVENTION

The invention relates to a bogie for rail vehicles.

BACKGROUND OF THE INVENTION

In rail vehicles the car body of the vehicle is connected via bogies with the rail wheels. The car body is pivotally supported on the bogie around a vertical axle. The rail wheels are fastened to axles which are supported on wheel bearing housings. The latter are guided relative to the bogie via longitudinal and transverse guide rods. The wheel bearing housings can be connected by an axle bridge which, via an oscillating link, is pivotally articulated on the bogie around a horizontal axle. The oscillating link takes over the steering of the axle. Thereby the axles or the wheel bearing housings can move vertically relative to the bogie and thus to the car body. For damping jerks and oscillations, springs and damping elements are situated, respectively, between the wheel bearing housing and the bogie and between the oscillating link and the bogie.

The rail wheels belonging to a bogie can be driven separately by electromotors or jointly by an electromotor via a differential gear and a corresponding connecting shaft. To this end, as a rule situated on the outer sides of the rail wheels upon lengthened wheel axles, there are spur gear drives which are mounted on separate gear housings. If the gears of two rail wheels are coupled with each other by a connecting shaft, a universal shaft joint and an axial longitudinal compensation are required to make it possible to compensate a center distance between the gears. The production and assemblage are expensive, due to the multiplicity of structural parts, and the sources of error are very numerous.

SUMMARY OF THE INVENTION

The problem on which the invention is based is to simplify the articulation of the rail wheels on the bogie and to reduce the number of parts.

According to the invention, the gear housings or housing form one unit with the wheel bearing housing and the oscillating link. Thereby a separate wheel bearing housing is eliminated and there results a rigid tie of the gear bearing housing to the oscillating link and a strong connection between the gear/bearing housings of two wheels. Even though the possibility exists that the gear/bearing housing deforms in the elastic area, said movements are so slight in the area of the connecting shaft that universal shaft joints are not needed for the power train.

Since the wheel bearing housing for the rail wheels and the gear hosing from one unit, an attachment in longitudinal direction of the vehicle to the oscillating link is possible, the wheel axle being guided by the gear/gearing housing and support therein. On one end of the wheel axle, the rail wheel is mounted and on the other end a brake disc is mounted so that the rail wheel and the brake disc with a brake caliper are situated on opposite sides of the gear/bearing housing. In advantageous manner, the oscillating link which interconnects the gear/bearing housing of two rail wheels is offset toward the bogie so as to lie outside an imaginary cylinder whose cross-section is formed by the outer limit of the rail wheels. Thereby both the part lying on the outer side of the gear/bearing housing and the one lying on the inner side are easily accessible, simple to maintain and to assemble.

Besides, the arrangement of the rail wheel and that of the brake disc with the brake caliper can be interchanged so that bogies substantially having equal parts can be made available for different track widths. It is especially convenient here that the width of the gear/bearing housing is selected so as to obtain, when assembling the rail wheels on the inner side, a narrow standard track such as of 1000 mm and when assembling the rail wheels on the outer side of the gear/bearing housing, a wide standard track of 1435 mm. Since the track widths are widely distributed on the market, such configuration can cover the greatest number of requirements demanded from bogies.

In development of the invention, it is proposed that the gear is designed as a spur gear drive with a gear wheel on the wheel axle, an intermediate wheel and an input pinion. Thereby a center distance between the axle and the connecting shaft can be arranged so that the connecting shaft can be passed through the hollow oscillating link and thus is protected against environmental influences and damages.

Other advantages result from the description of the drawing that follows. In the drawing is shown an embodiment of the invention. The specification and the claims contain numerous features in combination. The expert will conveniently regard the features separately and make with them added combinations. In the drawings:

DESCRIPTION OF THE PREFERRED EMBODIMENTS

Figure 1:
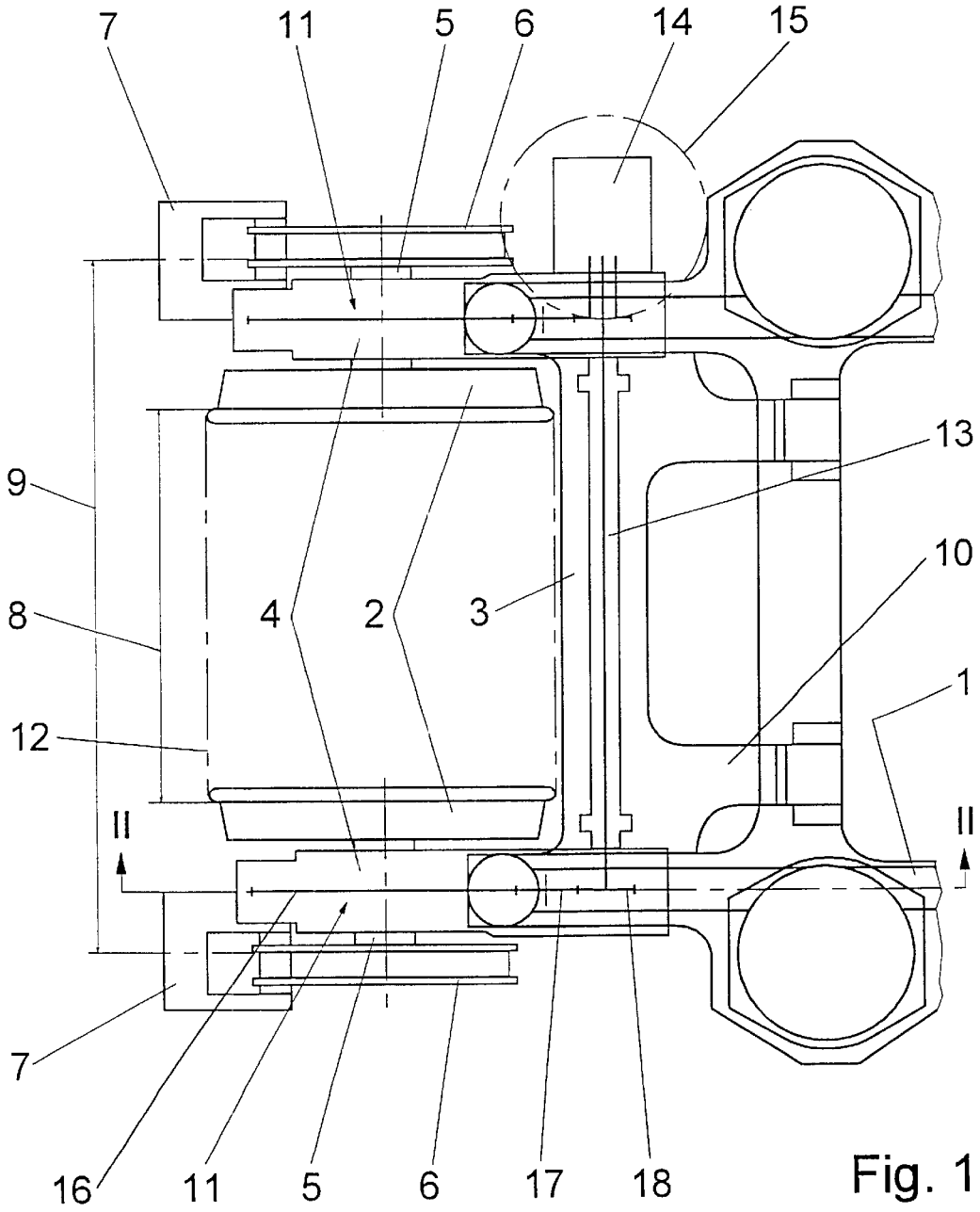
FIG. 1 is a diagrammatically observed top view of an inventive bogie.

A car body (not shown in detail) is pivotally supported on a bogie 1 around a vertical axle. In the bogie 1 is articulated with a swivel bearing 3 an oscillating link 10 pivotable around an axle 20 parallel with the wheel axle 5. The oscillating link 10 interconnects two gear/bearing housings 4. The oscillating link 10 and the gear/bearing housing 4 conveniently form an integral construction unit. As shown, the swivel bearings 3 can be situated outside the gear/bearing housing 4 or integrated in the gear/bearing housing in order to form an altogether more compact construction.

In the gear/bearing housing 4 are rotatably supported the wheel axles 5 which have fastened on one end a rail wheel 2 and on the other end a brake disc 6. The brake is formed by the brake disc 6, together with a brake caliper 7. The rail wheels 2 and the brake discs 6 are detachably connected with the wheel axles 5, e.g. by screw connection or pressed connections. The connections are designed in a manner such that the arrangement of the brake discs 6 is interchangeable with the arrangement of the rail wheels 2. The width of the gear/bearing housing 4 is conveniently selected so that with different arrangement of the rail wheels 2 two standard tracks 8 and 9 result, the narrow standard track 8 specifically amounting as a rule to 1000 mm and the wide standard track 9 to 1435 mm. With a great proportion of equal parts, the bogie 1 is thus adequate for the two most common track widths.

Figure 2:
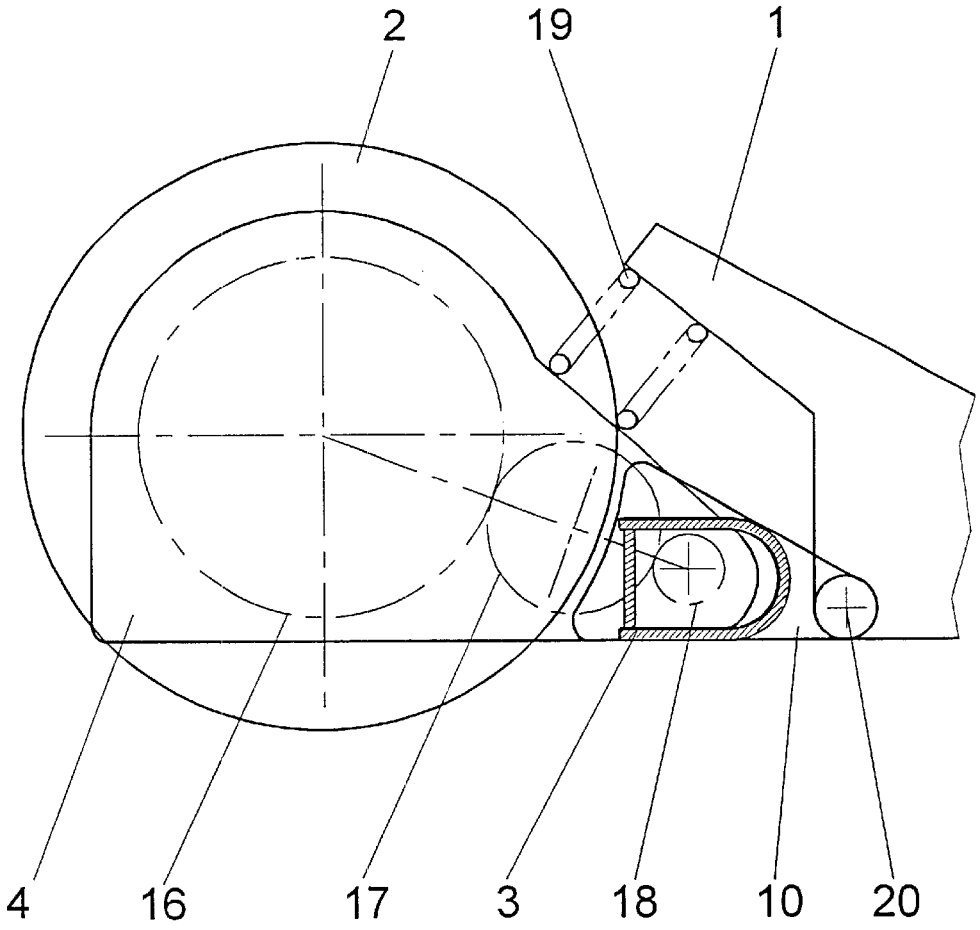
FIG. 2 is a diagrammatically observed section according to line II—II in FIG. 1.

In order that the rail wheels 2 can be assembled on the inner side between the gear/bearing housing 4, the otherwise usual axle bridge in the area of the wheel axles 5 is omitted. This axle bridge is replaced by the oscillating link 10 which can be offset toward the bogie 1 to an extent such as to lie outside an imaginary cylinder 12 whose cross-section is determined by the outer periphery of the rail wheels 2. The oscillating link 10 and the gear/bearing housing 4, respectively, support themselves via spring and damping elements opposite the bogie 1. FIG. 2 shows a primary spring 19 thereof.

Each rail wheel 2 can be separately driven by an electromotor 15. In the embodiment shown in FIG. 1, the electromotor 15 drives jointly the rail wheels 2 via a differential gear 14 and a simple connecting shaft 13 without universal joint, the same as via two gears 11. The gears 11 are spur gears drive and each have one gear wheel 16 which is non-rotatably connected with the wheel axle 5 and meshes with an intermediate wheel 17 driven by an input pinion 18. The connecting shaft 13 is passed through the hollow oscillating link 10 for protection against external influences and damage. 1 bogie gear 2 rail wheel 3 swivel bearing 4 gear/bearing housing 5 wheel axle 6 brake disc 7 brake caliper 8 standard track 9 standard track 10 oscillating link 11 gear 12 cylinder 13 connecting shaft 14 differential gear 15 electromotor 16 gearwheel 17 intermediate wheel 18 input pinion 19 primary spring 20 axle

I claim:

1. A bogie (1) for a rail vehicle having a pair of opposed rail wheels (2), each opposed rail wheel (2) being supported by a respectively laterally situated gear/bearing housing (4), each rail wheel (2) is driven via a gear drive train (11) accommodated within the respective gear/bearng housing (4), the respective gear/bearing housings (4) being interconnected with one another via an oscillating link (10) to form a rigid unit, and the oscillating link (10) being articulated to the bogie (1) to facilitate pivoting motion of the rigid unit with respect to the bogie (2);

wherein the gear (11) of each of the respective gear/bearing housings (4) are drivingly coupled with one another via a connecting shaft (13) and the said connecting shaft (13) is supported by the oscillating link (10).

2. The bogie (1) according to claim 1, wherein each of the respective gear/bearing housings (4) supports an axle (5) and a first end portion of the each axle (5) supports a disc brake (6) and a second opposed end portion of each axle (5) supports one of the pair of opposed rail wheels (2).

3. The bogie (1) according to claim 1, wherein the oscillation link (10) is offset toward the bogie (1) and lies outside an Imaginary cylinder (12) defined by an outer periphery of the rail wheels (2).

4. The bogie (1) according to claim 1, wherein a differential gear (14) drivingly couples the gear (11) of each of the respective gear/bearing housings (4) with one another.

5. The bogie (1), according to claim 1, wherein the gear (11) of each of the respective gear/bearing housings (4) comprises a spur Input pinion (18) driving a spur intermediate wheel (17) and a spur driven gear (16).

6. The bogie (1), according to claim 1, wherein each of the respective gear/bearing housings (4) supports an axle (5) an when a first end portion of the each axle (5) supports a disc brake (6) and a second opposed end portion of each axle (5) supports one of the pair of opposed rail wheels (2) the pair of opposed rail wheels (2) mate with wide standard track and when a first end portion of the each axle (5) supports one of the pair of opposed rail wheels (2) and a second opposed end portion of each axle (5) supports the disc brake (6), the pair of opposed rail wheels (2) mate with a narrow standard track.

7. The bogie (1) according to claim 1, wherein the articulation of the oscillation link (10) lies outside an Imaginary cylinder (12) defined by an outer periphery of the rail wheels (2).

8. A bogie (1) for a rail vehicle having a pair of opposed rail wheels (2), each opposed rail wheel (2) being supported by a respectively laterally situated gear/bearing housing (4), each rail wheel (2) is driven via a gear drive train (11) accommodated within the respective gear/bearing housing (4), the respective gear/bearing housings (4) being Interconnected with one another via an oscillating link (10) to form a rigid unit, and the oscillating link (10) being articulated to the bogie (1) to facilitate pivoting motion of the rigid unit with respect to the bogie (2);

wherein each of the respective gear/bearing housings (4) supports an axle (5) and when a first end portion of the each axle (5) supports a disc brake (6) and a second opposed end portion of each axle (5) supports one of the pair of opposed rail wheels (2) the pair of opposed rail wheels (2) mate with wide standard track and when a first end portion of the each axle (5) supports one of the pair of opposed rail wheels (2) and a second opposed end portion of each axle (5) supports the disc brake (6), the pair of opposed rail wheels (2) mate with a narrow standard track.

9. The bogie (1) according to claim 8, wherein each of the rail wheels (2) is rotatably connected to one of the wheel axles (5).

10. The bogie (1) according to claim 8, wherein when the pair of opposed rail wheels (2) is mounted adjacent to one another, the pair of opposed rail wheels (2) mate with the narrow standard track, and when the rail wheels (20) are mounted remote from one another, with the disc brakes located therebetween, the pair of opposed rail wheels (2) mate with the wide standard track.

* * * * *